US005419151A

United States Patent [19]

Minari et al.

[11] Patent Number: 5,419,151

[45] Date of Patent: May 30, 1995

[54] ICE MAKING MACHINE

[75] Inventors: Katsunobu Minari; Takao Kuroda, both of Nagoya, Japan

[73] Assignee: Hoshizaki Denki Kabushiki Kaisha, Toyoake, Japan

[21] Appl. No.: 279,080

[22] Filed: Jul. 22, 1994

Related U.S. Application Data

[63] Continuation of Ser. No. 68,549, May 28, 1993, abandoned.

[30] Foreign Application Priority Data

May 29, 1992 [JP] Japan ..... 4-163480

[51] Int. Cl.[6] ..... F25C 1/12

[52] U.S. Cl. ..... 62/347; 62/352

[58] Field of Search ..... 62/347, 340, 352, 73, 62/74, 66

[56] References Cited

U.S. PATENT DOCUMENTS

| | | | |
|---|---|---|---|
| 3,580,008 | 5/1971 | Barnard et al. | 62/347 |
| 4,412,429 | 11/1983 | Kohl | 62/347 |
| 4,458,503 | 7/1984 | Nelson | 62/347 |
| 4,590,774 | 5/1986 | Povajnuk | 62/347 |
| 4,719,762 | 1/1988 | Osabe | 62/137 |
| 4,907,415 | 3/1990 | Stewart, Jr. et al. | 62/347 X |

FOREIGN PATENT DOCUMENTS 1-31899 9/1989 Japan .

*Primary Examiner*—William E. Tapoical
*Attorney, Agent, or Firm*—Nikaido, Marmelstein, Murray & Oram

[57] ABSTRACT

An ice making machine in which ice making water in a static or flowing condition is gradually frozen on the surface of an ice making plate cooled at an ice making cycle of the machine, wherein the surface of said ice making plate is made of synthetic resin or glass.

7 Claims, 9 Drawing Sheets

SAMPLE 1

SAMPLE 1

SAMPLE 2a

SAMPLE 2b

SAMPLE 2c

SAMPLE 3

SAMPLE 4

SAMPLE 5a

SAMPLE 5b

SAMPLE 6

SAMPLE 7a

SAMPLE 7b

SAMPLE 7c

SAMPLE 8

ICE MAKING MACHINE

This application is a continuation of application Ser. No. 08/068,549 filed May 28, 1993, now abandoned.

BACKGROUND OF THE INVENTION

1. Field of the Invention

The present invention relates to an ice making machine in which ice making water is gradually frozen in a static or flowing condition on the surface of an ice making plate to be formed into ice.

2. Discussion of the Prior Art

Disclosed in Japanese Utility Model Publication No. 1-31899 is an ice making machine of the type which includes an inclined ice making plate with freezing means arranged to be supplied with ice making water from its upper portion for gradually forming the water into ice during flowing down thereon. There has been provided an ice making machine of the type which includes a plurality of ice making cells arranged to be supplied with ice making water ejected therein from their bottoms for forming the water into ice. There has been also provided an ice making machine of the type which includes an upright ice making plate arranged to be supplied with ice making water from its upper portion for forming the water into ice. In use of these ice making machines, it has been attempted to rise the cooling temperature of the ice making plate or change the material of the ice making plate to a material of low heat transfer coefficient so that crystal growth of the ice is delayed to produce hard clear ice of high transparence in a single crystal.

In such an attempt as described above, the ice making plate has been made of a metallic material such as copper, stainless steel, aluminum or the like to delay crystal growth of the ice. However, it was unable to efficiently produce the ice in the form of a large single crystal. The produced ice was in the form of fine multi-crystal particles which cause irregular groove-like stripes in the surface of the ice when molten at their crystal grain boundaries. Thus, the transparence of the ice is lost, and the ice becomes fine fragile crystals.

SUMMARY OF THE INVENTION

It is, therefore, a primary object of the present invention to provide an ice making machine capable of producing hard clear ice of high transparence in a large single crystal without causing the problems discussed above.

According to the present invention, there is provided an ice making machine in which ice making water in a static or flowing condition is gradually frozen on the surface of an ice making plate cooled at an ice making cycle of the machine, wherein the surface of the ice making plate is made of synthetic resin or glass.

In a practical embodiment of the present invention, it is preferable that the surface of said ice making plate is made of polyolefin, acrylonitrile-butadiene-styrene resin, polycarbonate or allyl-diglycol-carbonate monomer.

BRIEF DESCRIPTION OF THE DRAWINGS

Other objects, features and advantages of the present invention will be more readily appreciated from the following detailed description of certain preferred embodiments thereof when taken together with the accompanying drawings, in which.

DESCRIPTION OF THE PREFERRED EMBODIMENTS

Figure 1:
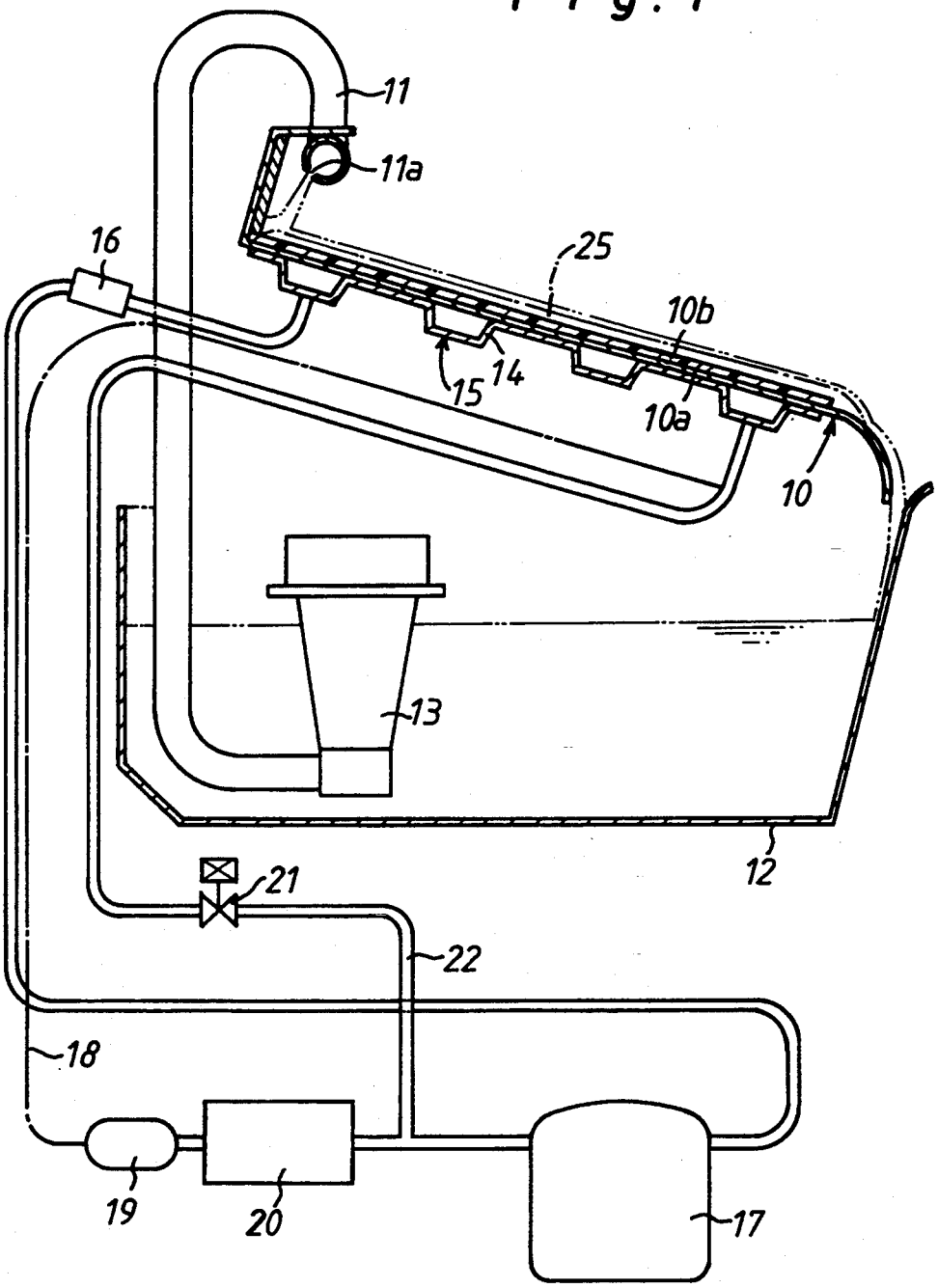
FIG. 1 is a schematic illustration of an ice making machine of the water circulation type according to the present invention.

In FIG. 1 of the drawings, there is schematically illustrated an lee making machine of the water circulation type which includes an ice making plate 10 provided thereon with an ice forming plate 10*a* the surface of which is formed as an ice forming surface 10*b*. The ice making plate 10 is arranged at an inclined angle to flow down ice making water supplied from a water tank 12 along the ice forming plate 10*b* and to circulate the water into the water tank 12. The ice making water is gradually frozen on the ice forming plate 10*b* during flowing down thereon and formed into an ice plate the crystal of which grows in a vertical direction. Arranged above an upper end of the ice making plate 10 is a longitudinal watering pipe 11 formed with a plurality of equally spaced watering holes 11*a*. The watering pipe 11 is connected to a water pump 13 disposed within the water tank 12. The ice making plate 10 is provided at its bottom with an evaporator 15 which is formed with a plurality of parallel refrigerant passages 14 connected to one another. The evaporator 15 has one end connected to a refrigerant compressor 17 through an accumulator 18 and the other end connected to an outlet of compressor 17 through a capillary 18, a dryer 19 and a condenser 20 and to a hot gas conduit 22 provided with a hot gas valve 21.

Figure 2:
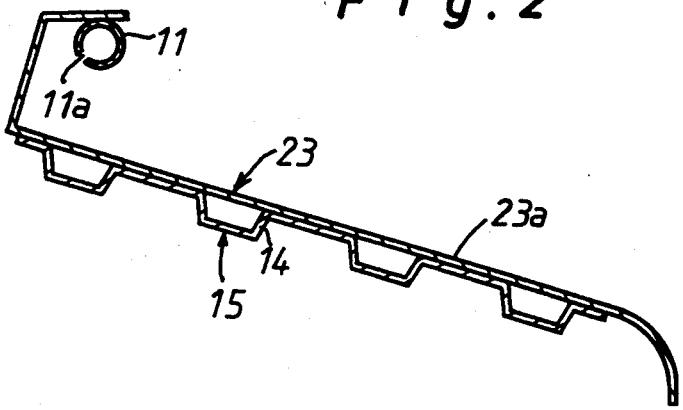
FIG. 2 is a sectional view of a modification of an ice making plate shown in FIG. 1.
Figure 3:
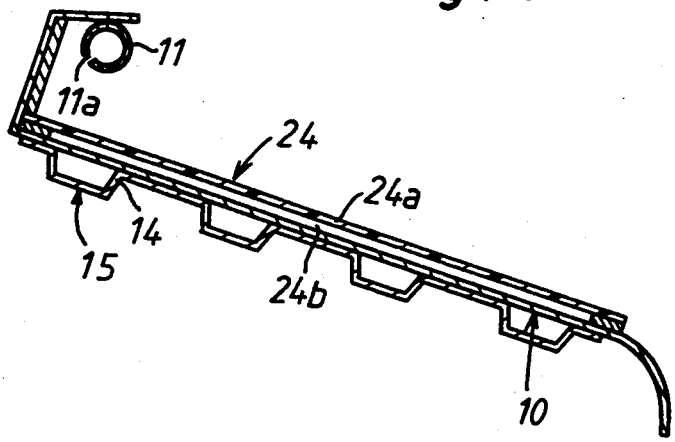
FIG. 3 is a sectional view of another modification of the ice making plate shown in FIG. 1.

In the ice making machine, the ice forming plate 10*a* is made of synthetic resin such as polyolefin such as polyethylene, acrylonitrile-butadiene-styrene resin, polycarbonate, allyl-diglycol-carbonate monomer or the like. Alternatively, the ice forming plate 10*a* may be made of glass. In the above arrangement, the ice forming plate 10*a* is directly attached to the surface of ice making plate 10 as shown In FIG. 1. Alternatively, as shown in FIG. 2, the ice making plate 10 itself may be replaced with an ice forming plate 23 made of synthetic resin or glass the surface of which is formed as an ice forming surface 23*a*. In the ice making machine, the ice forming plate 10*a* may be replaced with an ice forming plate 24 which is spaced from the ice making plate 10 to provide a heat insulating layer 24*b* by air as shown in FIG. 3. In this case, the surface of ice forming plate 24 is formed as an ice forming surface 24*a*. In a practical embodiment of the present invention, the ice making plate 10 itself may be coated with a thin layer of synthetic resin or glass.

Figure 4:
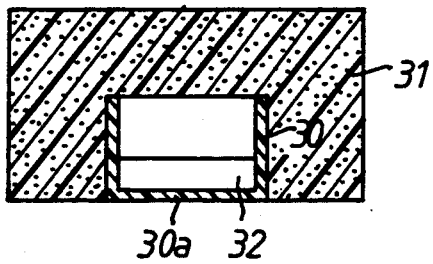
FIG. 4 is a sectional view of an ice making container adapted for use in an ice making machine of the static water type.

Although in the above embodiment the present invention has been adapted to an ice making machine of the water circulation type, the invention may be adapted to an ice making machine of the static water type which is provided with an ice making container 30 shown in FIG. 4. In this embodiment, the ice making container 30 is made of polyethylene and is covered at its side walls with a heat insulation layer 31 of polyurethane foam. Since the ice making container 30 is cooled at its bottom 30*a* , the internal surface of bottom 30*a* is formed as an ice forming surface 30*b*. In addition, the ice making container 30 may be made of other synthetic resin or glass.

Hereinafter, an ice making process in the ice making machine of the water circulation type according to the present invention will be described with reference to FIG. 1. Assuming that the compressor 17 and water pump 13 have been activated, the refrigerant compressed by the compressor 17 is supplied to the evaporator 15 through the condenser 20, dryer 19 and capillary 18 while the ice making water from tank 12 is supplied to the watering pipe 11. Thus, the surface 10*b* of ice forming plate 10*a* is cooled by heat exchange with the evaporator 15, and the ice making water flows down along the ice forming plate 10*a* from the watering holes 11*a* of pipe 11. During flowing down along the ice forming plate 10*a*, the ice making water is gradually frozen and circulated into the water tank 12 to be supplied to the watering pipe 11 under operation of the water pump 13. In such operation as described above, an lee core gradually grows on the surface 10*b* of lee forming plate 10*a*. After lapse of a predetermined time, an lee plate 25 of a predetermined thickness is formed on the surface 10*b* of ice forming plate 10*a*. When the hot gas valve 2l is opened at a defrost cycle of the ice making machine, the ice plate 25 is heated at its bottom and removed from the ice forming plate 10*a* to be harvested.

Figure 5:
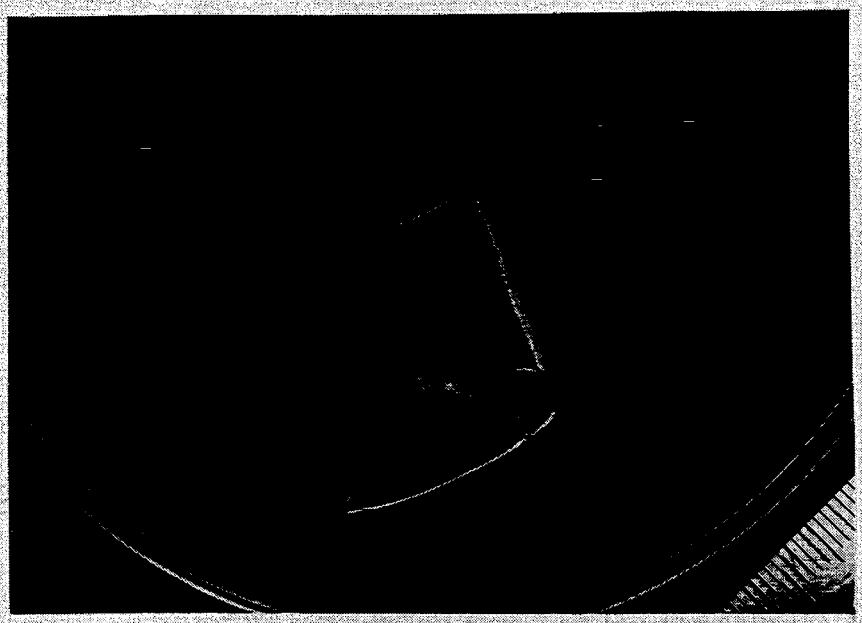
FIG. 5 is a photograph taken by use of a polarizing filter showing a slightly melted condition of an ice piece produced by the ice making machine of the present invention.
Figure 6:
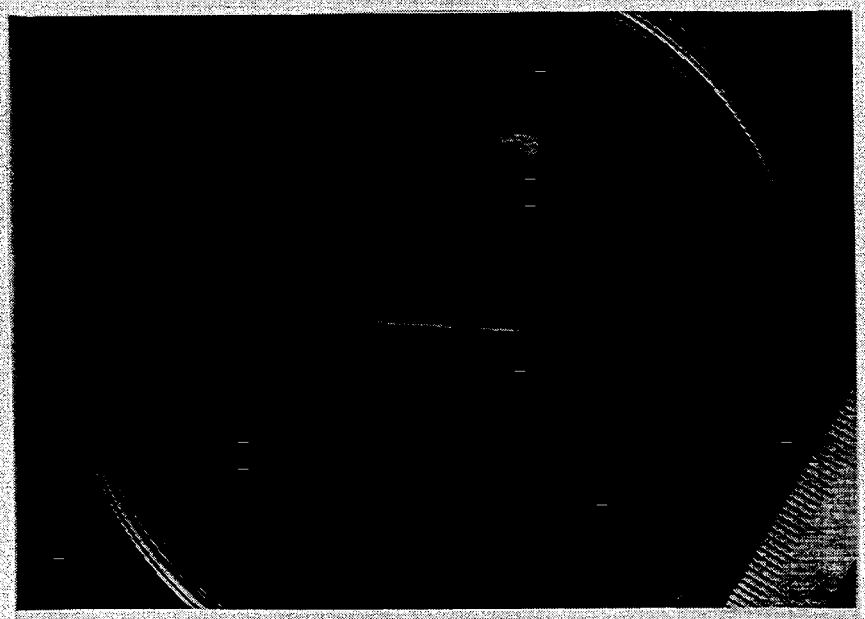
FIG. 6 is a photograph taken by use of a polarizing filter showing a sample 1 of ice produced in an experiment conducted to ascertain effects of the present invention.
Figure 7:
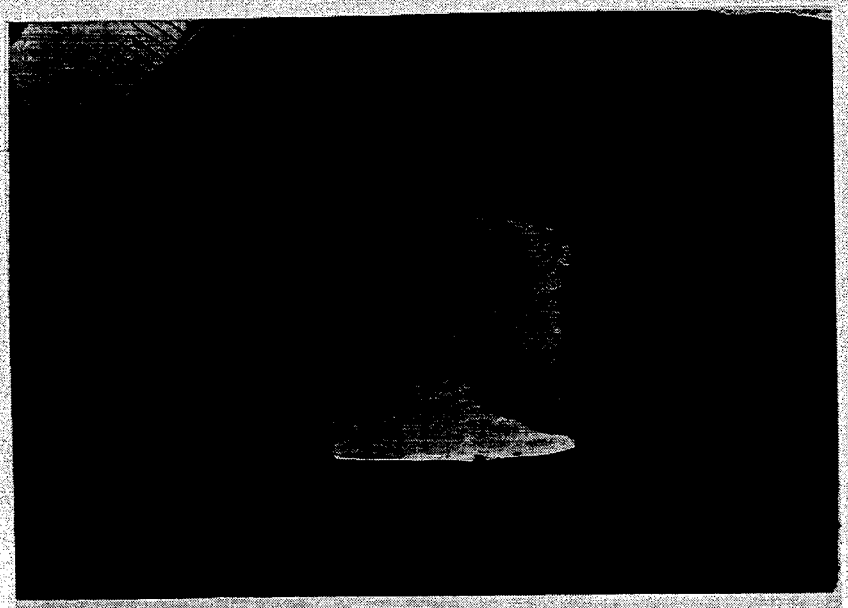
FIG. 7 is a photograph taken by use of a polarizing filter showing a sample 2*a* of ice produced in an experiment 2.
Figure 8:
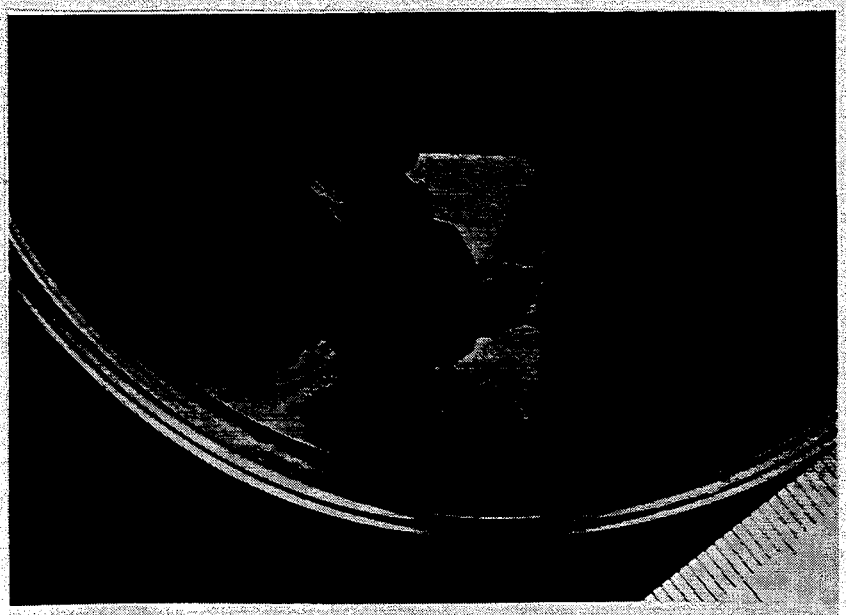
FIG. 8 is a photograph taken by use of a polarizing filter showing a sample 2*b* of ice produced in the experiment 2.
Figure 9:
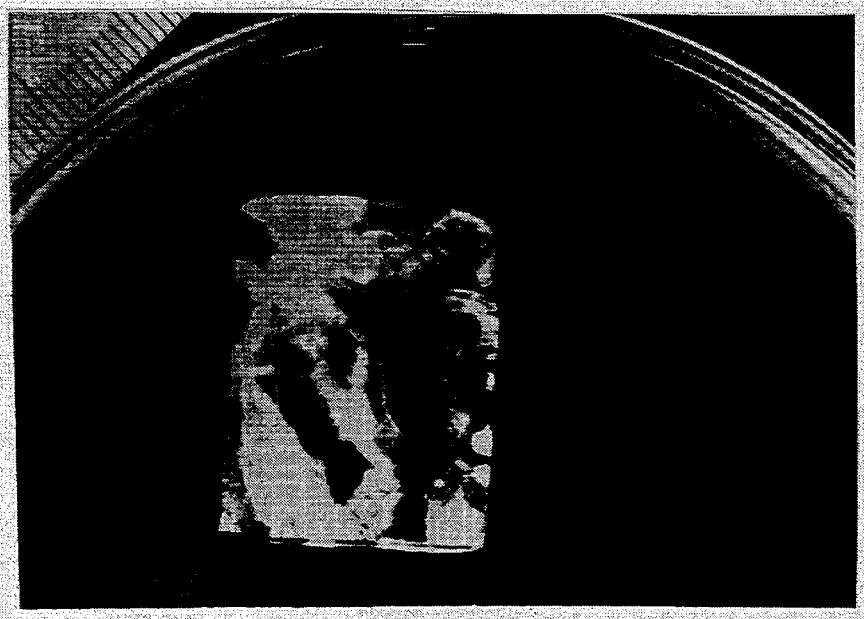
FIG. 9 is a photograph taken by use of a polarizing filter showing a sample 2*c* of ice produced in the experiment 2.
Figure 10:
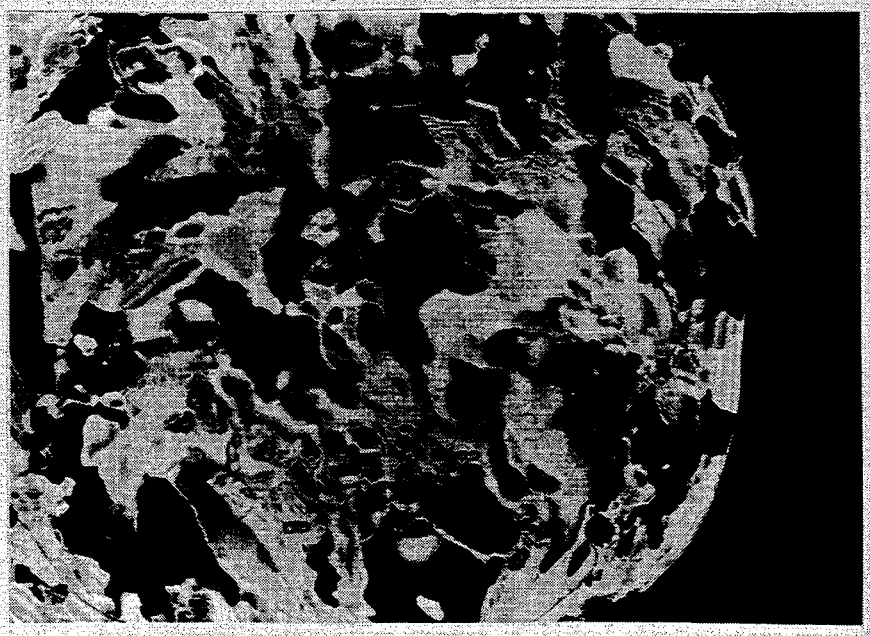
FIG. 10 is a photograph taken by use of a polarizing filter showing a sample 3 of ice produced in an experiment 3.
Figure 11:
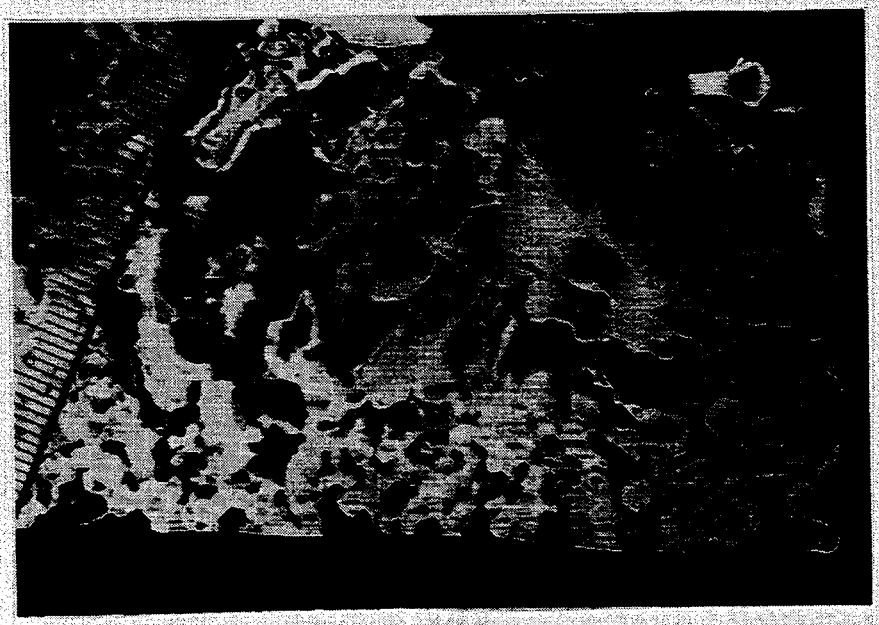
FIG. 11 is a photograph taken by use of a polarizing filter showing a sample 4 of ice produced in an experiment 4.

The ice plate is produced in the form of a hard transparent ice block of large crystal particles. Since a ratio of the crystal grain boundary per a unit surface area of the ice block becomes less than that of an ice block formed on a conventional metallic ice making plate made of stainless steel, aluminum or the like, a decrease of the ice block caused by melting and sublimation becomes small. When the ice block is cut into ice pieces of an appropriate size in a single crystal condition, each of the ice pieces is superior in transparency and is maintained in a high transparence during melting. The single crystal ice piece is noticeably hard in comparison with a multi-crystal ice piece. FIG. 5 is a photograph taken by use of a polarizing filter showing the single crystal Ice piece in a slightly melted condition. As recognized in the photograph, a regular twig-like pattern is formed in the single crystal ice piece.

As described below, a crystal condition of an ice plate produced by the ice making machine has been evaluated to demonstrate useful effects of the present invention. In the evaluation, the influence to crystal growth of the ice in a flowing condition or a static condition and the influence to crystal growth of the ice due to difference in materials of the ice forming surface have been evaluated by measuring the crystal particle size of the ice.

Experiment 1

In the ice making machine of the water circulation type shown in FIG. 1, the ice making plate 10 was made of stainless steel, and the ice forming plate 10*a* was made of ABS resin of 1 mm thickness. During an ice making cycle, the surface 10*b* of ice forming plate 10*a* was cooled to be maintained at −10° C. to produce an ice plate 25 during flowing down of the ice making water. The produced ice plate 25 was cut into ice pieces of a predetermined size, and a portion of the ice piece in close proximity to the ice forming surface 10*b* was cut into a thin ice piece which was adapted as a sample 1 for measurement of the crystal particle size of the ice.

Experiment 2

In a conventional ice making machine of the flow-down cell type, the internal surfaces of ice forming cells were coated with acrylonitrile-butadiene-styrene resin of 1 mm thickness. During an ice making cycle, the internal surfaces of the ice forming cells were cooled to be maintained at −10° C. to −20° C., and ice making water was supplied into the ice forming cells from its bottom to produce a plurality of ice cubes. Each portion of the ice cube in close proximity to the internal upper, bottom and side surfaces of the ice forming cells was cut into thin ice pieces which were adapted as samples 2*a* , 2*b* and 2*c* for measurement of the crystal particle size of the ice.

Experiment 3

In the ice making machine shown in FIG. 4, a container made of polyethylene resin of 1 mm thickness was adapted as the ice forming container 30, which was covered at its upper and side surfaces with a heat insulation layer 21 of polyurethane foam. The container 30 was supplied with ice making water of about 15° C. and cooled from its bottom surface 30*a* in a freezing cabinet of 31 5° C. to form an ice plate 32. A portion of the ice plate 32 in close proximity of the bottom surface 30a of container 30 was cut into a thin ice piece which was adapted as a sample 3 for measurement of the crystal particle size of the ice.

Experiment 4

In the ice making machine of the water circulation type shown in FIG. 1, the ice making plate 10 was made of stainless steel, and the ice forming plate 10a was made of glass of 2 mm. An ice plate was produced under the same condition of the experiment 1 and cut into a thin ice piece which was adapted as a sample 4 for measurement of the crystal particle size of the ice.

Experiment 5

In the ice making machine shown in FIG. 4, a container 30A made of polycarbonate and a container 30B made of CR-39 monomer (a trademark of allyl-diglycol-carbonate monomer made by PPG Industries, Inc.) were adapted as the container 30, respectively. An ice plate was produced by using the respective containers 30A and 30B in the same condition of the experiment 3. The ice plates were cut into thin ice pieces which were adapted as samples 5a and 5b for measurement of the crystal particle size of the ice.

Comparative Experiment 1

In the ice making machine of the water circulation type shown in FIG. 1, an ice plate was produced on the ice making plate 10 of stainless steel without providing the ice forming plate 10a under the same condition of the experiment 1. The ice plate was cut into a thin ice piece which was adapted as a sample 6 for measurement of the crystal particle size of the ice.

Comparative Experiment 2

In the ice making machine of the flow down cell type used in the experiment 2, a plurality of ice cubes were produced in the ice forming cells without coating any synthetic resin therein under the same condition of the experiment 2. Each portion of the ice cubes in close proximity to the upper, bottom and side surfaces of the cells was cut into thin ice pieces which were adapted as samples *7a* , *7b* and *7c*.

Comparative Experiment 3

In the ice making machine shown In FIG. 4, a container of stainless steel of 0.8 mm was adapted as the container 30. Within the container, an ice plate was produced under the same condition of the experiment 3 and cut into a thin ice piece which was adapted as a sample 8 for measurement of the particle size of the ice.

The measurement of the samples 1–8 was conducted by counting the number of crystal particles per a predetermined unit area through a polarizing filter and calculating an average value of the crystal particle size based on the following formula.

$$d=(6/\pi N)^{\frac{1}{2}}$$

where D is the average particle size, and N is the number of crystal particles per the predetermined unit area.

The formula is described in Journal of Energy Resources Technologh., Sep. 1985 Vol. 107/369-375, "Grain Size and the Compressive Strength of Ice", Cole, D. M. (1985). The calculation result of the average particle size was confirmed as follows: the sample 1 was 17.8 mm, the sample 3 was 4.7 mm, the sample 4 was 8.2 mm, the sample 6 was 3.5 mm and the sample was 1.9 mm. In FIGS. 6 to 18, there are shown all the photographs of the samples 1–8 which were taken by use of a polarizing filter.

Evaluation (1) From the result of the above measurement, it has been found that the average particle size of the ice crystals produced on the ice forming surface of synthetic resin or glass is larger than that of the ice crystals produced on the ice making plate of stainless steel. It has been also found that the crystal particle size of the ice produced in a flowing condition becomes larger than that of the ice produced in a static condition. In comparison of the experiment 1 with the comparative experiment 1, it has been recognized that the difference in heat transfer coefficient does not cause the difference in the crystal particle size because the thickness of the ice forming plate 10a in the experiment 1 was only 1 mm.

Figure 12:
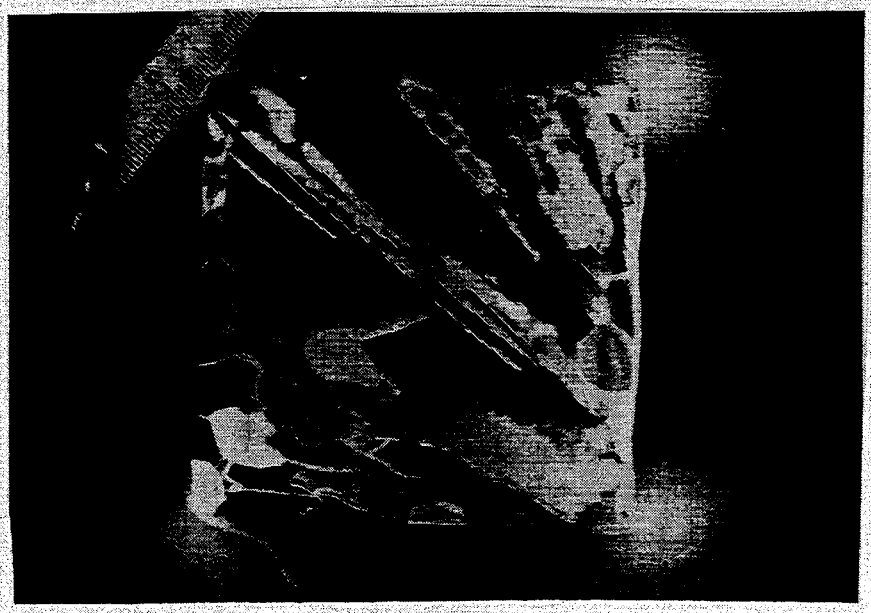
FIG. 12 is a photograph taken by use of a polarizing filter showing a sample 5*a* of ice produced in an experiment 5.
Figure 13:
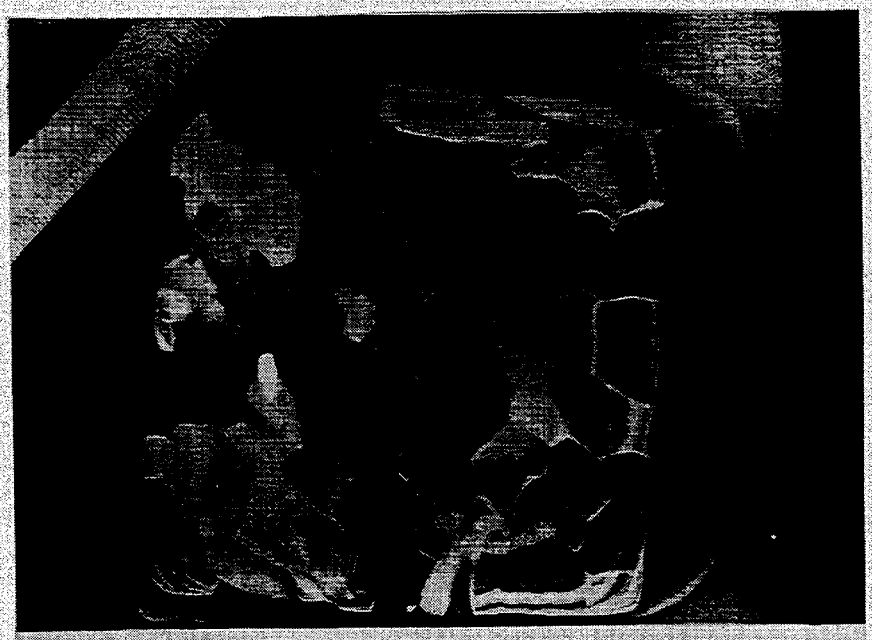
FIG. 13 is a photograph taken by use of a polarizing filter showing a sample 5*b* of ice produced in the experiment 5.
Figure 14:
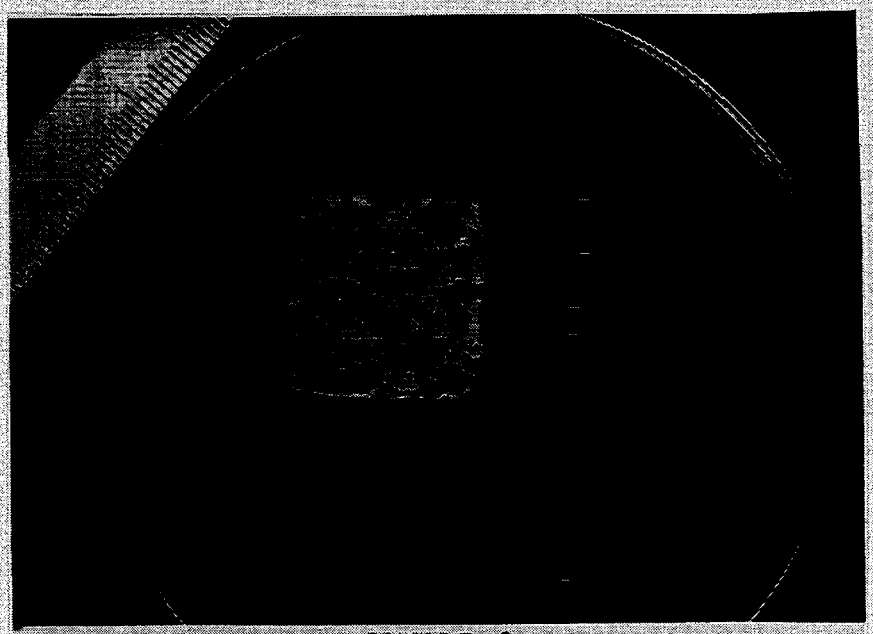
FIG. 14 is a photograph taken by use of a polarizing filter showing a sample 6 of ice produced in a comparative experiment 1.
Figure 15:
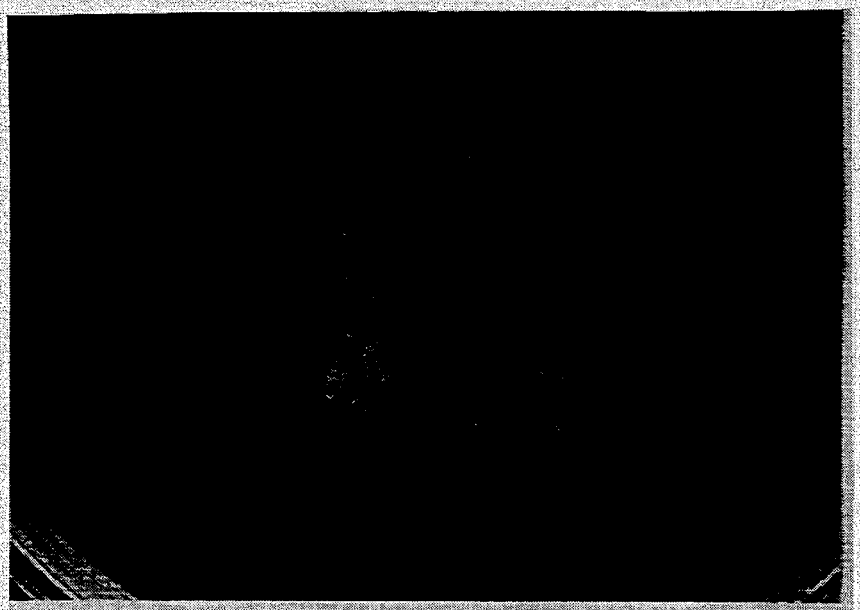
FIG. 15 is a photograph taken by use of a polarizing filter showing a sample 7*a* of ice produced in a comparative experiment 2.
Figure 16:
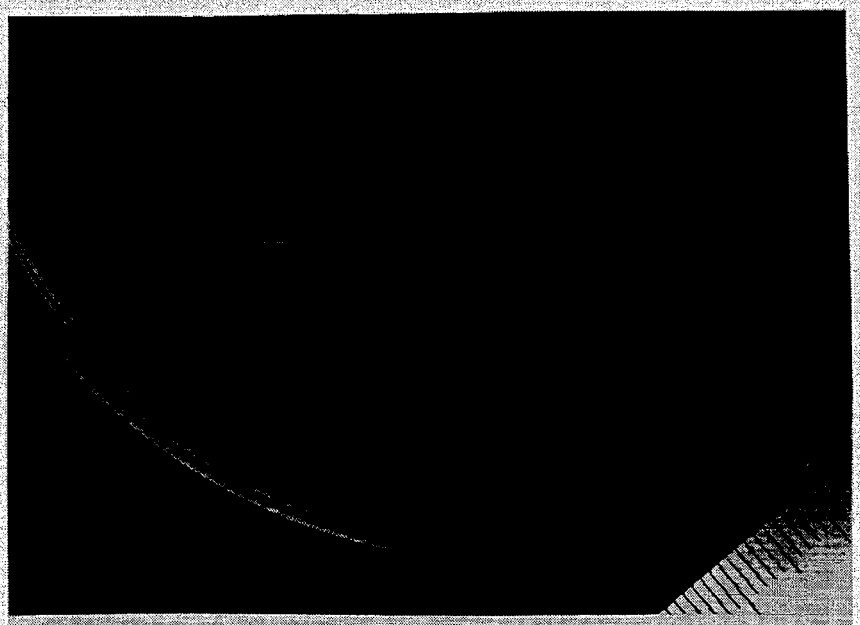
FIG. 16 is a photograph taken by use of a polarizing filter showing a sample 7*b* of ice produced in the comparative experiment 2.
Figure 17:
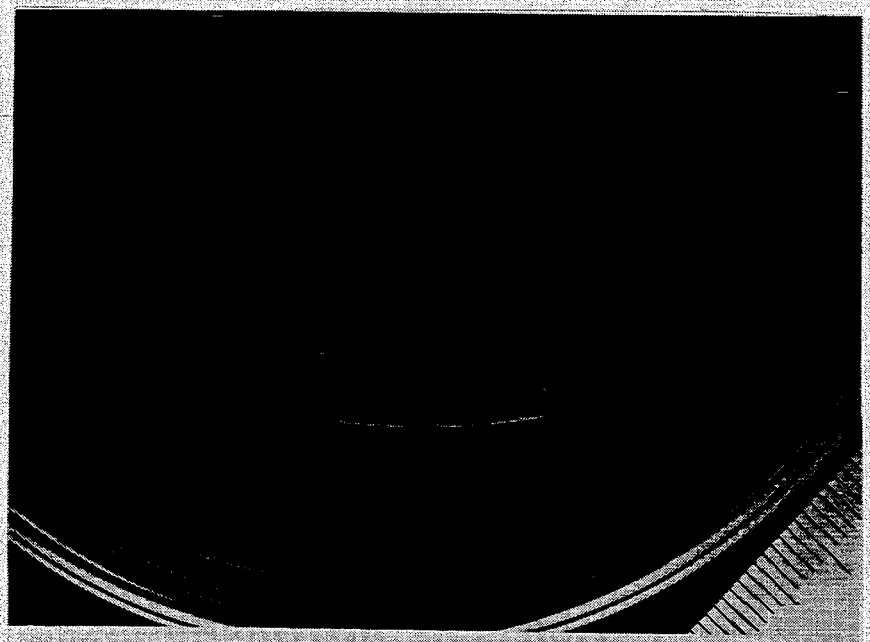
FIG. 17 is a photograph taken by use of a polarizing filter showing a sample 7*c* of ice produced in the comparative experiment 2.
Figure 18:
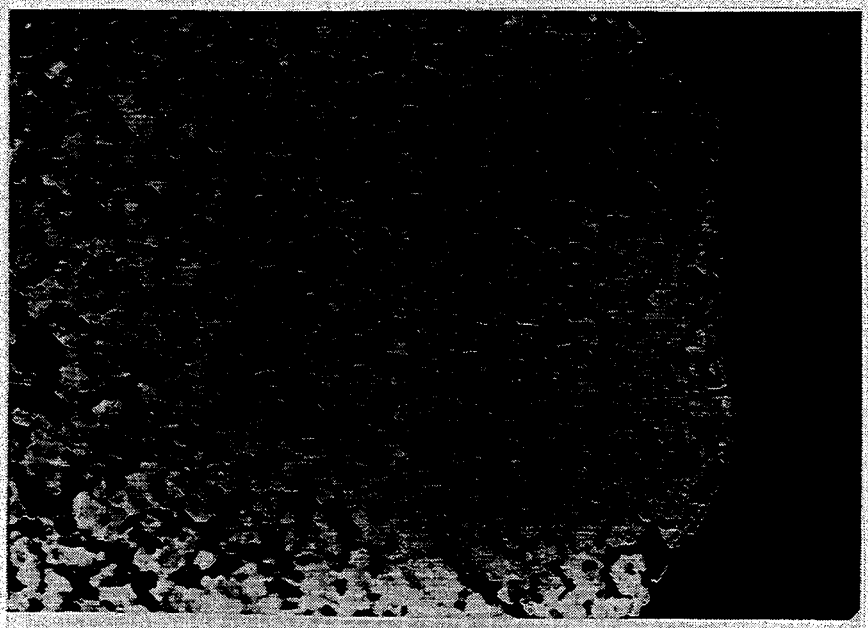
FIG. 18 is a photograph taken by use of a polarizing filter showing a sample 8 of ice produced in a comparative experiment 3.

(2) Referring to the photographs of FIGS. 12 and 13, the ice piece of the sample 5a produced on the ice forming surface of polycarbonate in the experiment 5 was formed of large crystal particles in a high transparence. However, it has been found that the ice piece of the sample 5 was formed to have unclear crystal grain boundaries and unclear stripes in its single crystal. Such a phenomenon of the ice piece is caused by dislocation in the single crystal. For this reason, the hardness and strength of the ice piece becomes relatively low. In contrast with the sample 5a, the ice piece of the sample 5b produced on the ice forming surface of allyl-diglycol-carbonate monomer was formed to have clear crystal grain boundaries as shown in FIG. 13. Since the molecular dislocation density of the single crystal is relatively low, the hardness and strength of the ice piece becomes high, and also the transparence of the ice piece becomes high.

What is claimed is:

1. An ice making machine in which ice making water in a static or flowing condition is gradually frozen on a surface of an ice making plate cooled at an ice making cycle of the machine, wherein an ice forming plate is attached to the surface of the ice making plate to form an ice forming surface thereon, said ice forming plate being made of synthetic resin or glass, for lowering a heat transfer coefficient of the ice making plate.

2. An ice making machine as claimed in claim 1, wherein said ice forming plate is made of polyolefin.

3. An ice making machine as claimed in claim 1, wherein said ice forming plate is made of acrylonitrile-butadiene-sytrene resin.

4. An ice making machine as claimed in claim 1, wherein said ice forming plate is made of polycarbonate.

5. An ice making machine as claimed in claim 1, wherein said ice forming plate is made of allyl-diglycol-carbonate monomer.

6. An ice making machine as recited in claim 1, wherein said ice making machine utilizes a defrost harvest cycle for harvesting ice from said ice forming plate.

7. An ice making machine as recited in claim 1, wherein said ice forming plate is spaced from said ice making plate to provide a heat insulating layer by air.

* * * * *